US010654679B2

(12) United States Patent
Mochizuki

(10) Patent No.: US 10,654,679 B2
(45) Date of Patent: May 19, 2020

(54) MEDIUM PROCESSING DEVICE AND IMAGE FORMING APPARATUS

(71) Applicant: KYOCERA Document Solutions Inc., Osaka (JP)

(72) Inventor: Masayuki Mochizuki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/292,368

(22) Filed: Mar. 5, 2019

(65) Prior Publication Data

US 2019/0276262 A1 Sep. 12, 2019

(30) Foreign Application Priority Data

Mar. 8, 2018 (JP) ..... 2018-042299

(51) Int. Cl.
*B65H 33/08* (2006.01)
*B65H 43/00* (2006.01)
*B65H 31/02* (2006.01)

(52) U.S. Cl.
CPC ..... *B65H 33/08* (2013.01); *B65H 31/02* (2013.01); *B65H 43/00* (2013.01); *B65H 2301/42194* (2013.01); *B65H 2511/13* (2013.01); *B65H 2511/152* (2013.01); *B65H 2511/22* (2013.01); *B65H 2511/30* (2013.01)

(58) Field of Classification Search
CPC ..... B65H 33/06; B65H 33/08; B65H 33/10; B65H 2511/13; B65H 2515/10; B65H 2511/152; B65H 31/34; B65H 2511/12; B65H 2301/4219; B65H 2301/42194; B65H 2301/4222; G03G 15/6547; G03G 2215/0089
See application file for complete search history.

(56) References Cited

U.S. PATENT DOCUMENTS 8,033,543 B2 * 10/2011 Hayashi ..... B65H 31/34 271/213
8,251,362 B2 * 8/2012 Konishi ..... B65H 31/10 270/58.12

(Continued)

FOREIGN PATENT DOCUMENTS

JP H06-032443 U 4/1994
JP 2009-113958 A 5/2009
JP 2014-129148 A 7/2014

*Primary Examiner* — Jeremy R Severson
(74) *Attorney, Agent, or Firm* — Studebaker & Brackett PC

(57) ABSTRACT

A medium processing device includes a discharge member, a discharge tray, a shift part and a control part. The discharge member is configured to discharge a medium from a discharge position in a discharge direction. On the discharge tray, the medium is stacked. The shift part is configured to vary a relative position of the discharge position and the discharge tray in a shift direction perpendicular to the discharge direction to shift a shift position where the medium is stacked on the discharge tray. The control part is configured to control the shift part so as to shift the shift position for each medium bundle containing a plurality of the mediums. The control part calculates a thickness of the medium bundle, and when the calculated thickness exceeds a first threshold value, the control part makes it possible to select a number of the shift position from a plurality of candidates.

9 Claims, 8 Drawing Sheets

(56) References Cited

U.S. PATENT DOCUMENTS

| | | | | |
|---|---|---|---|---|
| 8,505,911 | B2 * | 8/2013 | Tamada | B65H 31/10<br>271/213 |
| 8,662,489 | B2 * | 3/2014 | Arai | B65H 31/10<br>270/58.07 |
| 8,955,838 | B2 | 2/2015 | Saito et al. | |

* cited by examiner

FIG. 9

T

| WEIGHT OF SHEET [g/m$^2$] | THICKNESS OF SHEET [mm] |
|---|---|
| ~63 | 0.05 |
| 64~74 | 0.07 |
| 75~90 | 0.09 |
| 91~105 | 0.12 |
| 106~135 | 0.14 |
| 136~170 | 0.16 |
| 171~220 | 0.18 |
| 220~ | 0.2 |

MEDIUM PROCESSING DEVICE AND IMAGE FORMING APPARATUS

INCORPORATION BY REFERENCE

This application is based on and claims the benefit of priority from Japanese Patent application No. 2018-042299, filed on Mar. 8, 2018, which is incorporated by reference in its entirety.

BACKGROUND

The present disclosure relates to a medium processing device including a discharge tray on which a discharged sheet-shaped medium is stacked, and an image forming apparatus provided with the medium processing device.

In an image forming apparatus, such as a multifunctional peripheral and a printer, a sheet-shaped medium, such as a paper sheet, on which an image is formed is discharged on a discharge tray through a discharge port. Conventionally, the image forming apparatus has a function in which a plurality of sheets is set to one unit (one bundle), and when the plurality of units (the plurality of bundles) is printed collectively, the plurality of units is sorted for each unit (that is, for each sheets bundle).

For example, there is a technique such that when a bundle of stapled sheets is discharged on the discharge tray, a discharge speed of a discharge roller of a shift mechanism is controlled to vary a discharge speed of the bundle of stapled sheets discharged on the discharge tray and to displace a position of the bundle of stapled sheets staked on the discharge tray in the discharge direction. Alternatively, in a configuration that the sheet fed from the discharge port is post-processed on the sub-tray and then stored in the stack tray, there is another technique such that the sheets are divided into one sheet group which is conveyed to the stack tray and another sheet group which is collected in the sub-tray to displace the sheet groups in the width direction. There is still another technique such that the recording sheets discharged from the copying machine sequentially are aligned for each bundle of sheets.

A user takes out the mediums stacked on the stack tray for each medium bundle separately. Easiness of taking out of the medium bundles separately is dependent on a thickness of the medium bundle, for example. However, the above described techniques do not demonstrate a control considering easiness of taking out of the medium bundles separately.

SUMMARY

In accordance with an aspect of the present disclosure, a medium processing device includes a discharge member, a discharge tray, a shift part and a control part. The discharge member is configured to discharge a sheet-shaped medium from a discharge position in a predetermined discharge direction. On the discharge tray, the medium discharged by the discharge member is stacked. The shift part is configured to vary a relative position of the discharge position and the discharge tray in a shift direction perpendicular to the discharge direction to shift a shift position where the medium is stacked on the discharge tray. The control part is configured to control the shift part so as to shift the shift position for each medium bundle containing a plurality of the mediums. The control part calculates a thickness of the medium bundle, and when the calculated thickness exceeds a first threshold value, the control part makes it possible to select a number of the shift position from a plurality of candidates.

In accordance with an aspect of the present disclosure, an image forming apparatus includes the medium processing device.

The above and other objects, features, and advantages of the present disclosure will become more apparent from the following description when taken in conjunction with the accompanying drawings in which a preferred embodiment of the present disclosure is shown byway of illustrative example.

BRIEF DESCRIPTION OF THE DRAWINGS

FIG. 9 is a table showing an example of weight information in the medium processing device according to the embodiment of the present disclosure.

DETAILED DESCRIPTION

Hereinafter, with reference to the attached drawings, an embodiment of the present disclosure will be described. In the following description, a discharge direction of a sheet S or the like is represented by a Y direction, a stack direction of the sheet S or the like is represented by a Z direction and a shift direction of the sheet S or the like, which is perpendicular to the discharge direction and the stack direction, is represented by a X direction, for convenience of explanation.

1. A Multifunctional Peripheral

Figure 1:
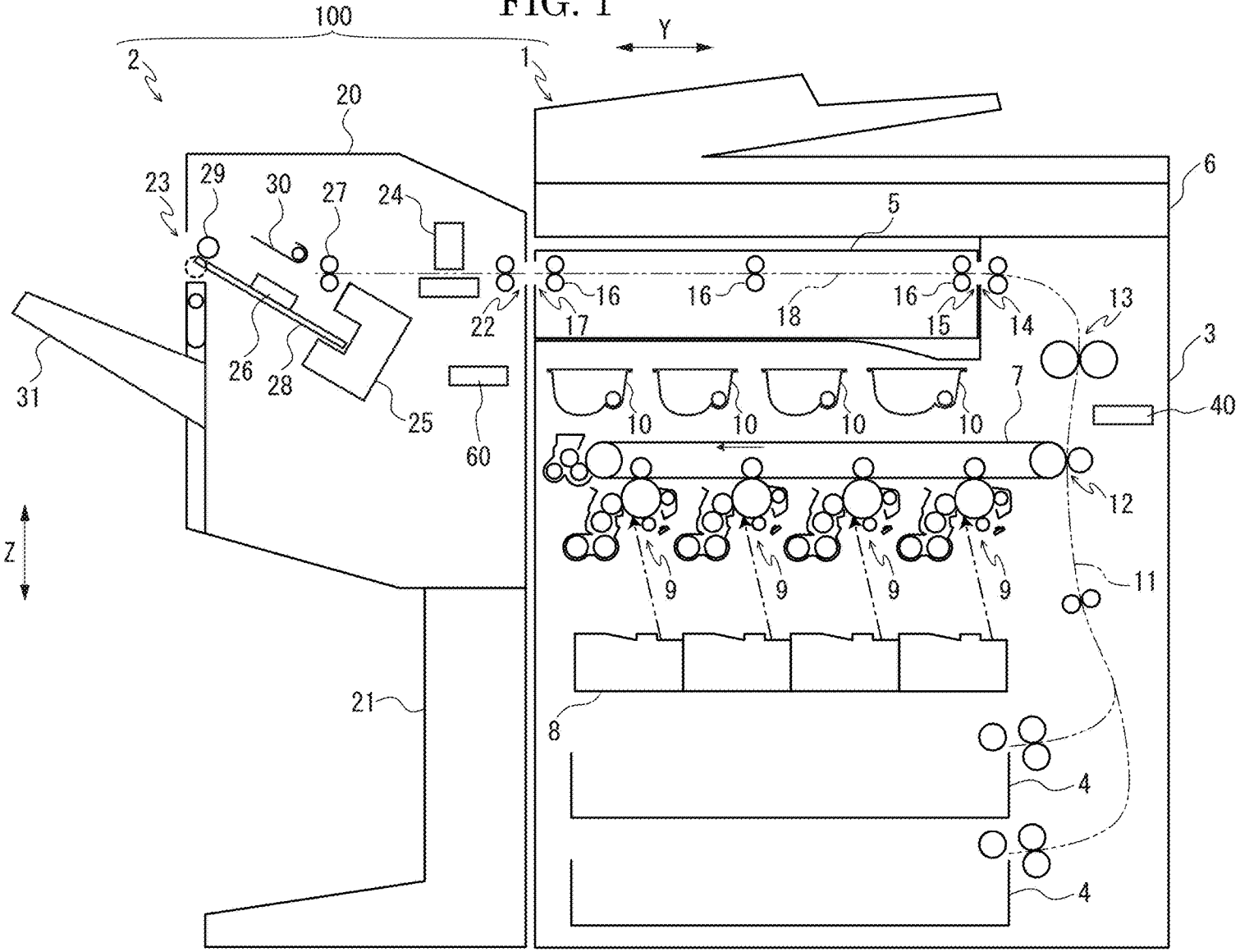
FIG. 1 is a sectional view showing an image forming apparatus according to an embodiment of the present disclosure.

With reference to FIG. 1, first, a multifunctional peripheral 1 according to one embodiment of the present disclosure will be described. FIG. 1 is a sectional view schematically showing an image forming apparatus 100 including the multifunctional peripheral 1 and a medium processing device 2. A front-and-rear direction (a near-and-far direction) of FIG. 1 corresponds to the X direction, a left-and-right direction of FIG. 1 corresponds to the Y direction and an upper-and-lower direction of FIG. 1 corresponds to the Z direction.

As shown in FIG. 1, the image forming apparatus 100 includes the multifunctional peripheral 1 forming an image on the sheet S and the medium processing device 2 subjecting a post-processing (for example, a punching processing, a staple processing and a sorting processing) to the sheet S on which the image is formed.

The multifunctional peripheral 1 includes an approximately box-shaped casing 3. In a lower portion of the casing 3, a sheet feeding cassette 4 storing a sheet S, such as a copy paper, is provided. The sheet S is not limited to a paper recording material, such as a copy paper; includes any recording materials widely, for example, a resin recording material such as a film and an OHP sheet.

In an upper portion of the casing 3, an in-body sheet discharge space is provided. In the in-body sheet discharge space, a relay conveyance unit 5 constituting a conveyance path for the sheet S from the multifunctional peripheral 1 to the medium processing device 2 is provided. Above the casing 3, an image reading device 6 which reads a document and produces an image data is provided.

In a center portion of the casing 3, an intermediate transferring belt 7 is bridged between a plurality of rollers. Below the intermediate transferring belt 7, an exposure device 8 constituted by a laser scanning unit (LSU) and the others is provided. Along a lower portion of the intermediate transferring belt 7, image forming parts 9 corresponding to colors (four colors of magenta, cyan, yellow and black, for example) of toners (developers) are provided.

Each image forming part 9 includes a rotatable photosensitive drum, and a charging part, a development part, a primary transferring part, a cleaning part and a static eliminating part which are arranged around the photosensitive drum in the order of a first transferring processing. Above each development part, a toner container 10 storing the toner of the corresponding color is provided.

Along one side (the right side in FIG. 1) inside the casing 3, a conveyance path 11 for the sheet S is provided. At an upstream end of the conveyance path 11, the sheet feeding cassette 4 is provided, at a midstream portion of the conveyance path 11, a secondary transferring part 12 containing a part of the intermediate transferring belt 7 is provided, at a downstream portion of the conveyance path 11, a fixing part 13 is provided, and at a downstream end of the conveyance path 11, a multifunctional peripheral side sheet discharge port 14 is provided.

The multifunctional peripheral 1 includes a first control part 40 and a touch panel 50. The first control part 40 controls each part of the image forming apparatus 100 (the multifunctional peripheral 1 and the medium processing device 2) to perform an image forming operation and a post-processing operation. The touch panel 50 shows information regarding the image forming operation to a user, produces a signal corresponding to an operation received from the user, and outputs the produced signal to either one of or both the first control part 40 and a second control part 60.

2. The Relay Conveyance Unit

Next, the relay conveyance unit 5 will be described. As shown in FIG. 1, the relay conveyance unit 5 includes a relay side sheet feeding port 15, a plurality of relay supply rollers 16 and a relay side sheet discharge port 17. The relay side sheet feeding port 15 and the relay side sheet discharge port 17 are opened to both side faces of the relay conveyance unit 5.

The relay side sheet feeding port 15 is provided at a position facing the multifunctional peripheral side sheet discharge port 14 of the casing 3 when the relay conveyance unit 5 is attached to the multifunctional peripheral 1. The plurality of relay supply rollers 16 constitutes a relay conveyance path 18 for the sheet S from the relay side sheet feeding port 15 to the relay side sheet discharge port 17. The relay side sheet discharge port 17 is provided at a position facing the medium processing device 2 when the relay conveyance unit 5 is attached to the multifunctional peripheral 1.

3. An Image Forming Processing

The multifunctional peripheral 1 performs the image forming operation as follows. When the image data is input to the multifunctional peripheral 1 from the image reading device 6 or an external personal computer connected via a network (that is, when a printing start is instructed), first, a surface of the photosensitive drum charged by the charging part is exposed by the exposing part 8 according to the image data. A static latent image formed on the photosensitive drum by the above exposing is developed into a toner image by the development part. The above toner image is primarily transferred on the intermediate transferring belt 7 at the primary transferring part. The above operation is repeated by each image forming part 9 to form a full color toner image on the intermediate transferring belt 7. The toner and charge remaining on each photosensitive drum are removed by the cleaning part and the static eliminating part, respectively.

On the other hand, the sheet S fed from the sheet feeding cassette 4 is conveyed to the secondary transferring part 12 in accordance with the above described image forming operation. The full color toner image on the intermediate transferring belt 7 is secondarily transferred on the sheet S, and the sheet S on which the full color toner image is formed is conveyed to the fixing part 13 along the conveyance path 11. The sheet S on which the full color toner image is fixed by the fixing part 13 is discharged through the multifunctional peripheral side sheet discharge port 14, and introduces to the medium processing device 2 through the relay conveyance unit 5.

4. The Medium Processing Device

Figure 2:
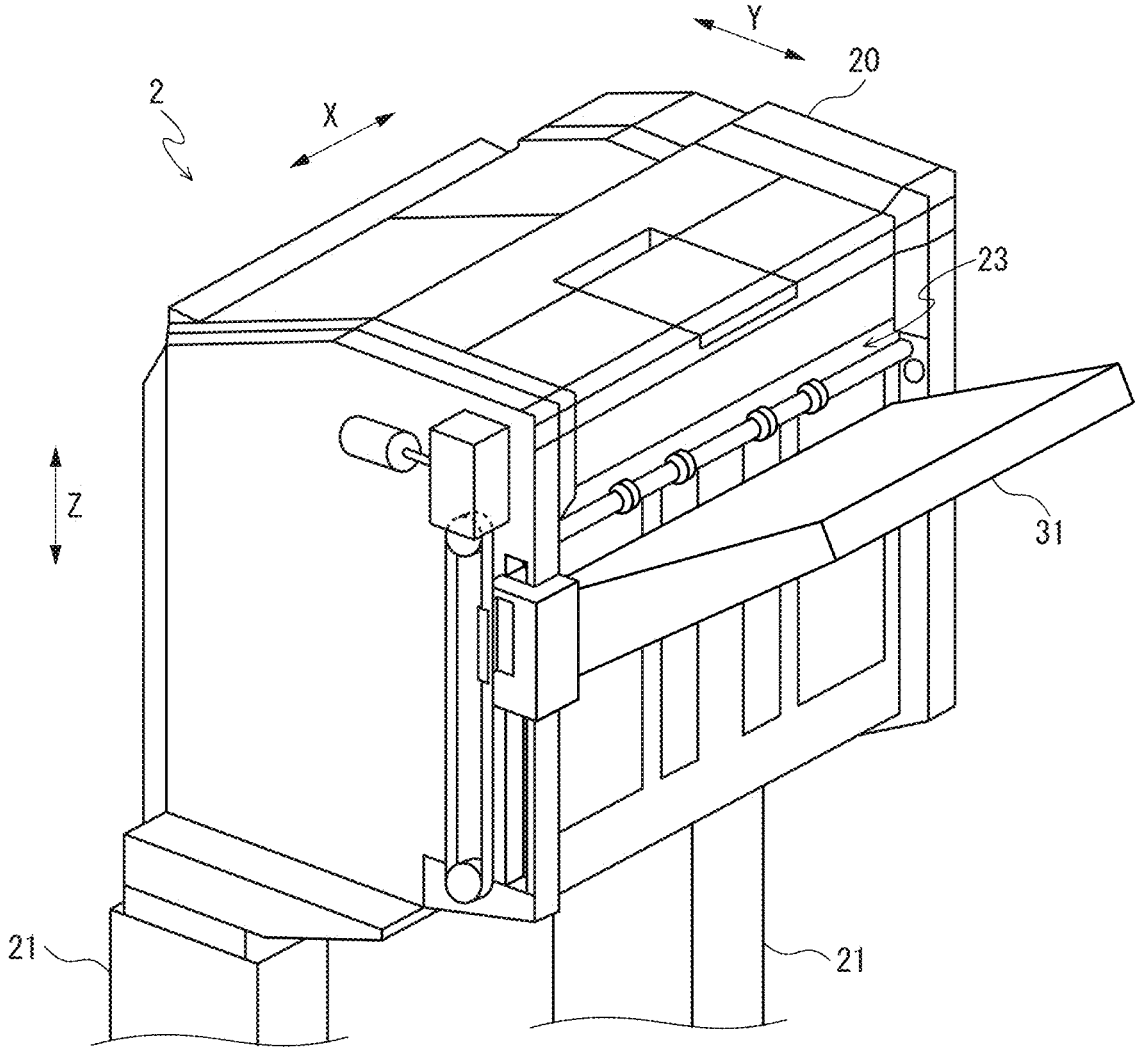
FIG. 2 is a sectional view showing a medium processing device, a part of which is cut out, according to the embodiment of the present disclosure.

With reference to FIG. 1 and FIG. 2, the medium processing device 2 will be described. On the left side in FIG. 1, the medium processing device 2 is shown. FIG. 2 is a perspective view showing the medium processing device 2 attached to the multifunctional peripheral 1, in which a part of the medium processing device 2 is cut out. The medium processing device 2 includes an approximately box-shaped casing 20. On a lower face of the casing 20, a leg part 21 is provided. In other words, the casing 20 of the medium processing device 2 is supported by the leg part 21.

The casing 20 has a post-processing side sheet feeding port 22 and a post-processing side sheet discharge port 23. The post-processing side sheet feeding port 22 is opened to the casing 20 at a side of the multifunctional peripheral 1 (the right side in FIG. 1) and the post-processing side sheet discharge port 23 is opened to the casing 20 at an opposite side (the left side in FIG. 1) to the post-processing side sheet feeding port 22. The post-processing side sheet discharge port 23 is a portion from which the sheet S is discharged in the Y direction (the discharge direction).

Inside the casing 20, a punching part 24, a staple part 25 and a shift part 26 are provided along a conveyance path for the sheet S from the post-processing side sheet feeding port 22 to the post-processing side sheet discharge port 23. The punching part 24 forms a punch hole in the sheet S, the staple part 25 staples for each predetermined number of the sheets S and the shift part 26 adjusts a position of the sheet S in the X direction (the width direction, that is, the shift direction). The casing 20 may include a part performing another processing (a folding processing or the like), in addition to the above parts.

Inside the casing 20, a conveyance roller 27, a processing tray 28 and a discharge roller 29 are provided along the conveyance path for the sheet S. The conveyance roller 27 and the discharge roller 29 convey the sheet S. Above the processing tray 28, an alignment member 30 is provided. The alignment member 30 is an element which comes into contact with the sheet S conveyed by the conveyance roller 27 and displaces a rear end of the sheet S close to the staple part 25 on the processing tray 28 to align the sheet S when the shift processing is performed, for example.

The conveyance roller 27 is arranged at the downstream side of the punching part 24 and at the upstream side of the shift part 26 on the conveyance path for the sheet S. The conveyance roller 27 conveys the sheet S conveyed from the post-processing side sheet feeding port 22 directly (that is, without being processed at the punching part 24) and the sheet S subjected to the punching processing at the punching part 24 to the downstream side.

The processing tray 28 is arranged at the downstream side of the conveyance roller 27 on the conveyance path for the sheet S. On the processing tray 28, the sheet S to be processed at the staple part 25 or the shift part 26 is temporarily placed (stacked). A first end portion (a downstream side end portion) of the processing tray 28 is arranged at a side of the post-processing side sheet discharge port 23, and a second end portion (an upstream side end portion) of the processing tray 28 is arranged at a side of the staple part 25. When the rear end of the sheet S comes into contact with the second end portion of the processing tray 28, the rear end of the sheet S is aligned.

The discharge roller 29 is arranged at a side of the first end portion of the processing tray 28. The discharge roller 29 discharges the sheet S placed on the processing tray 28 for each of the sheets S or for each of the bundles (that is, the plurality of sheets S). The discharge roller 29 is constituted by a pair of rollers which sandwich the bundle of sheets S (the medium bundle) from the upper side and the lower side, for example.

When the discharge roller 29 is rotated, the bundle of sheets S is discharged from the processing tray 28 on the discharge tray 31 through the post-processing side sheet discharge port 23. That is, the discharge roller 29 is a discharge member which discharges the sheet S along the discharge direction through the post-processing side sheet discharge port 23. The pair of rollers constituting the discharge roller 29 is configured such that one roller is movable so as to be away from or come into pressure contact with the other roller. That is, the rollers constituting the discharge roller 29 are separated away each other when the sheet S is placed on the processing tray 28, and come into pressure contact with each other so as to sandwich the bundle of sheets S with a nip pressure suitable for the number of the sheets S when the bundle of sheet S placed on the processing tray 28 is discharged.

The discharge tray 31 is provided protruding outward from a left side face of the casing 20. On the discharge tray 31, the sheet S discharged through the post-processing side sheet discharge port 23 is stacked.

Figure 3:
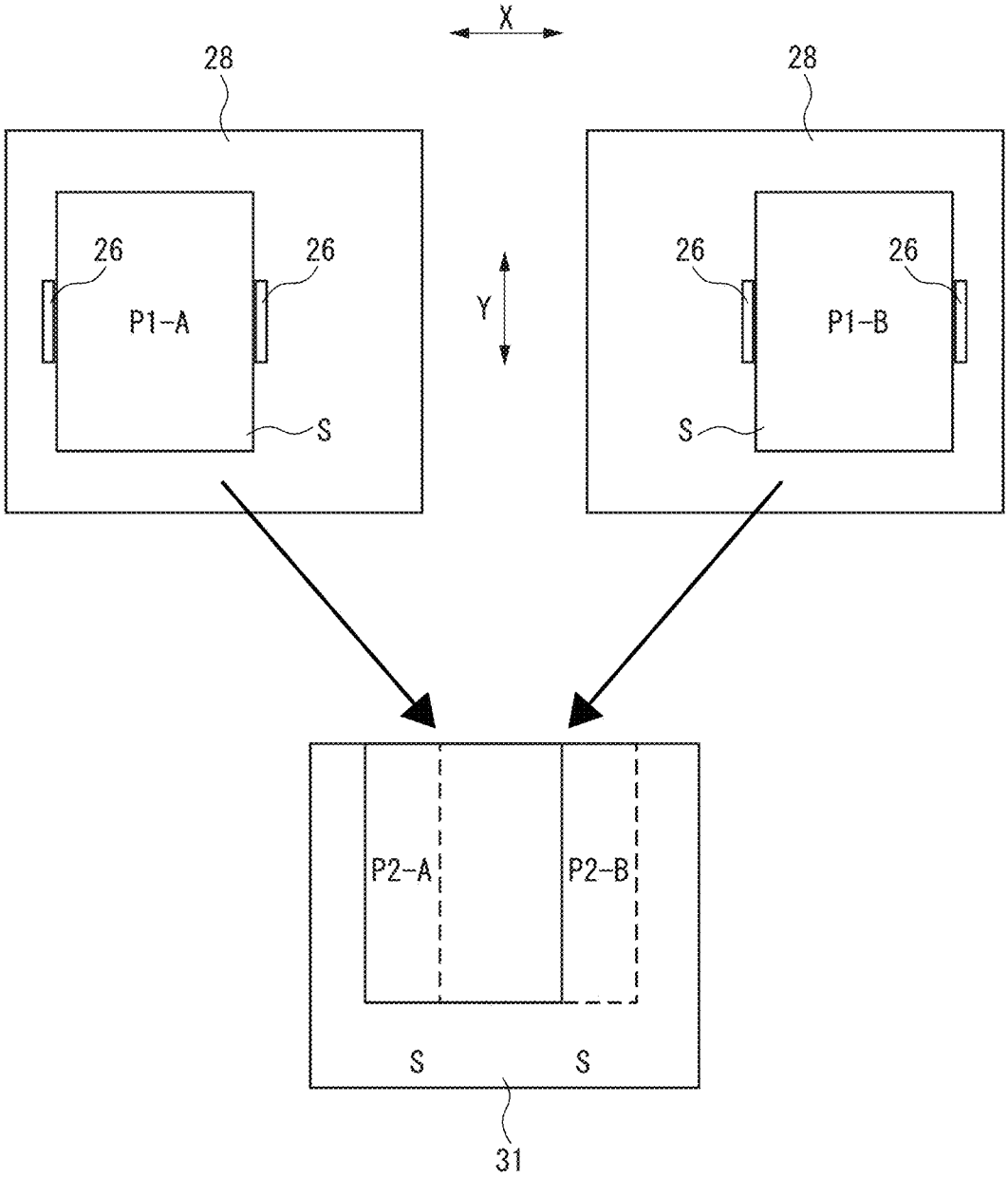
FIG. 3 is a view explaining a variation of a shift position in the medium processing device according to the embodiment of the present disclosure.

As shown in FIG. 3, the shift part 26 of the present embodiment is a pair of regulate guides which regulate a position of the sheet S in the shift direction (the X direction). The shift part 26 is rocked in the shift direction (the X direction) by a rocking mechanism (not shown) such as a motor or a gear.

When the rocking mechanism rocks the shift part 26, a placement position of the sheet S on the processing tray 28 is shifted in the shift direction. As a result, a discharge position from which the sheet S is discharged to the discharge tray 31 is shifted, and a shift position where the discharged sheet S is stacked on the discharge tray 31 is also shifted. For example, as shown in FIG. 3, the sheet S placed on the placement position P1-A on the processing tray 28 is discharged through the post-processing side sheet discharge port 23 and stacked on the shift position P2-A (shown by a solid line in FIG. 3) on the discharge tray 31; the sheet S placed on the placement position P1-B is discharged and stacked on the shift position P2-B (shown by a broken line in FIG. 3). As understood from the above description, in the example of FIG. 3, a number of the shift position P2 is 2 (two).

That is, the shift part 26 shifts the placement position of the sheet S on the processing tray 28 (accordingly, the discharge position of the sheet S with respect to the discharge tray 31) in the shift direction (the X direction) perpendicular to the discharge direction (the Y direction) so as to shift the shift position where the sheet S is stacked on the discharge tray 31. The above shift operation of the placement position, the discharge position and the shift position may be performed for each sheet S or each bundle containing a plurality of sheets S.

The medium processing device 2 includes the second control part 60. The second control part 60 cooperates with the first control part 40 of the multifunctional peripheral 1 and controls each part of the medium processing device 2 to perform the post-processing operation.

5. The Control Part

Figure 4:
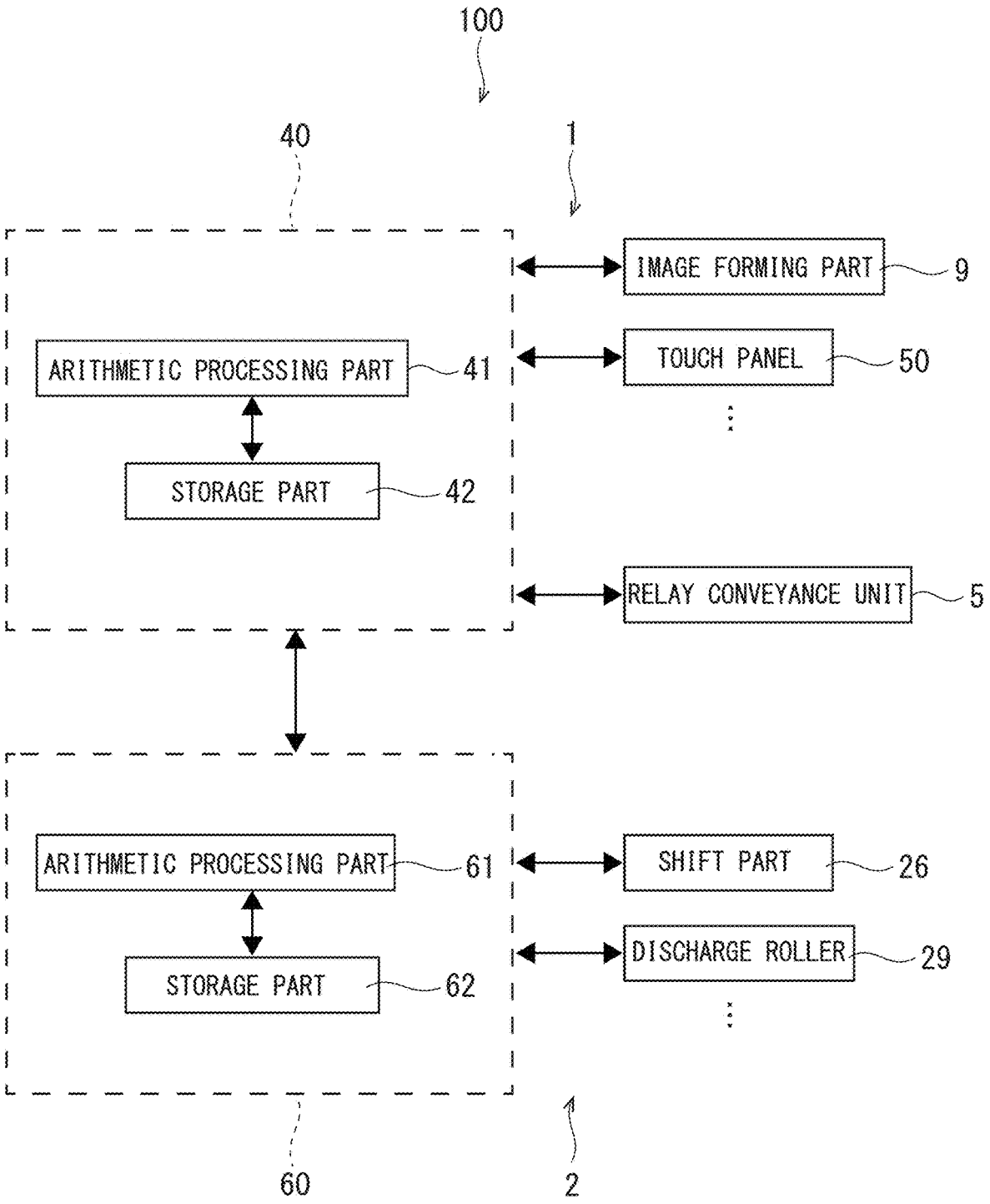
FIG. 4 is a block diagram showing a control part of the image forming apparatus according to the embodiment of the present disclosure.

With reference to FIG. 4, the first control part 40 of the multifunctional peripheral 1 and the second control part 60 of the medium processing device 2 will be described. The first control part 40 is a control device constructed by a microcomputer, and includes an arithmetic processing part 41 and a storage part 42. The arithmetic processing part 41 includes a microprocessor as a CPU (central processing unit) and the storage part 42 includes a ROM (read only memory) and a RAM (random access memory). The ROM is a readable recording memory storing a program used for control of the image forming apparatus 100 (the multifunctional peripheral 1 and the medium processing device 2). The RAM is a readable and writable recording medium, serves as a main storage device and stores written information. The storage part 42 may further include an auxiliary storage device, such as a flash memory. The second control part 60 is a control device constituted in the same way as the first control device 40, and includes an arithmetic processing part 61 and a storage part 62.

The arithmetic processing part 41 of the first control part 40 executes a predetermined processing referring to the information stored in the RAM according to the program stored in the ROM. The arithmetic processing part 41 logically builds various function blocks achieved by the processing according to the program. The arithmetic processing part 41 writes various information obtained by the processing in the storage part 42. The arithmetic processing part 61 and the storage part 62 of the second control part 60 serve as the above described way. The first control part 40 may cooperate with the second control part 60 to execute various control processing.

The first control part 40 is electrically connected to each part (the image forming part 9, the touch panel 50 and the others) of the multifunctional peripheral 1, the relay conveyance unit 5 and the second control part 60 of the medium processing device 2. The second control part 60 is electrically connected to each part (the shift part 26, the discharge roller 29 and the others) of the medium processing device 2 in addition to the first control part 40.

The second control part 60 may cooperate with the first control device 40 to control the shift part 26 such that the shift position P2 on the discharge tray 31 is shifted for each sheet bundle B containing a plurality of the sheets S.

6. Control of the Shift Position

As described above, the image forming apparatus 100 (the medium processing device 2) of the present embodiment allows the sheet S to discharge on a plurality of the shift positions P2 different from each other in the width direction (the X direction, the shift direction). A distance between end portions of the plurality of shift positions P2 different from each other in the width direction (a shift distance) is preferably set based on easiness of taking out the sheets S (the sheet bundles B) separately for a user.

A case where the user judges that if the shift distance between the sheet bundles B is larger than 30 mm, it is easy to take out the sheet bundles B separately is assumed. The post-processing side sheet discharge port 23 of the medium processing device 2 has a predetermined width. In a case of a A4-size sheet adaptable machine having a width of the post-processing side sheet discharge port 23 of 240 mm, because the A4-size sheet has a width of 210 mm, a specification provided with the 2 (two) shift positions P2 having the shift distance of 30 mm (a configuration that a number of candidates of the shift position P2 is "2 (two)") is applied.

However, depending on the user's purpose, there is a case where the 3 (three) or more shift positions P2 are needed. In this case, if the shift distance decreases simply, it becomes difficult for the user to take out the sheet bundles B separately, resulting in deterioration of convenience for the user.

Regarding the shift position P2 where the sheet S is stacked on the discharge tray 31 will be further discussed from the user's convenience side. In a case where the sheets S are sorted for each sheet bundle, discharged and then stacked on the discharge tray 31, the user takes out the sheets S for each sheet bundle B (medium bundle) separately. Easiness of taking out the sheet bundles B separately is dependent on a thickness of the sheet bundle B, for example.

Figure 5:
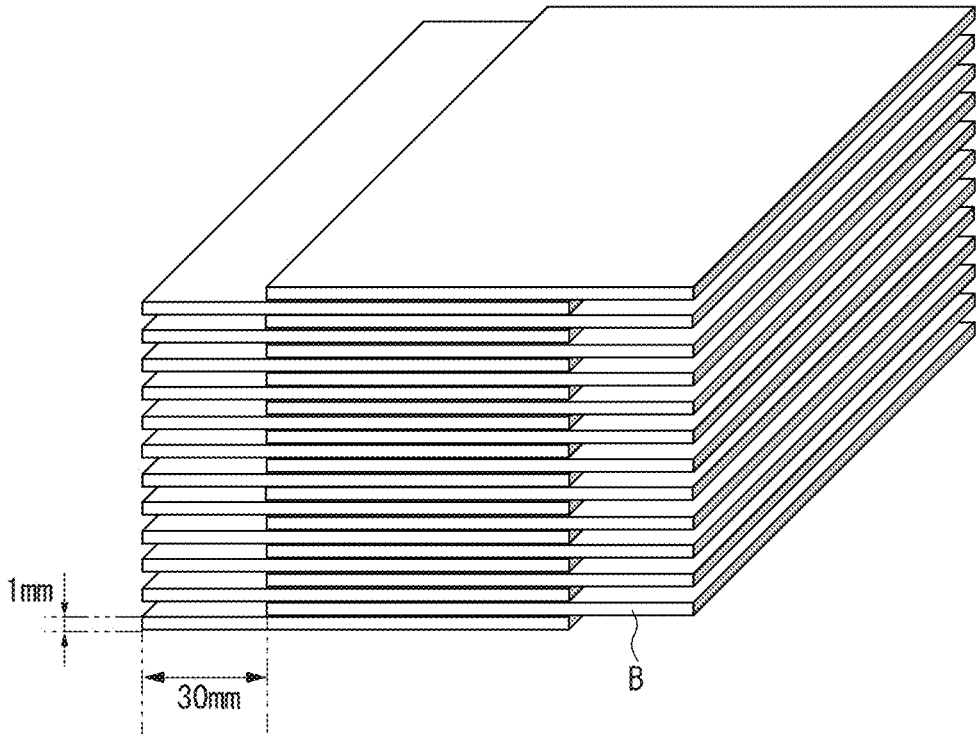
FIG. 5 is a view showing an example of a sheet bundle (a medium bundle) according to the embodiment of the present disclosure.
Figure 6:
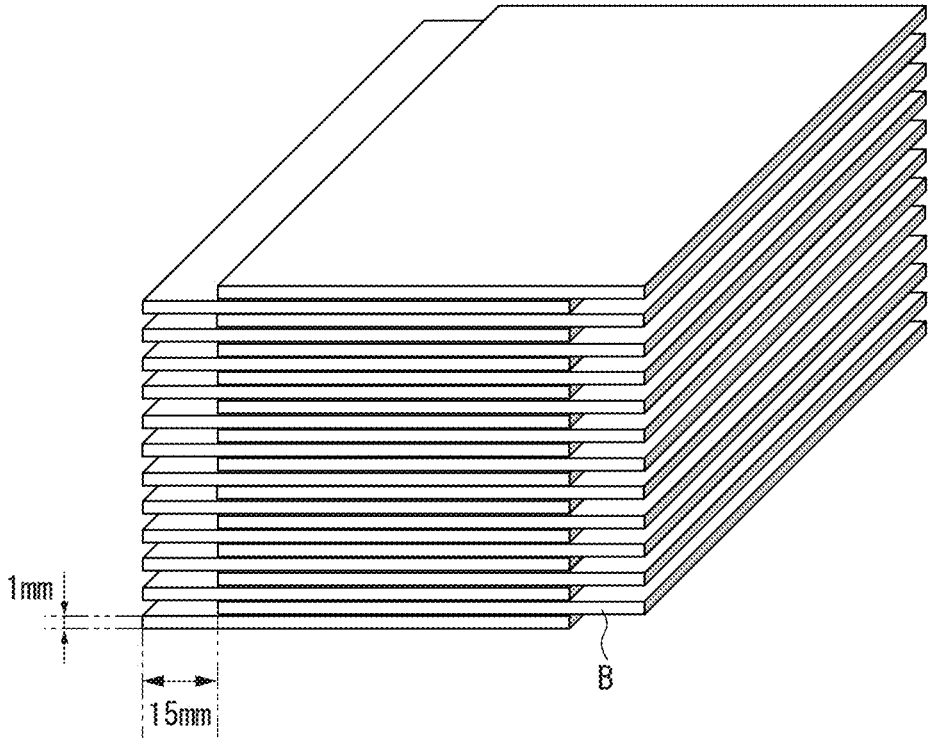
FIG. 6 is a view showing another example of a sheet bundle (a medium bundle) according to the embodiment of the present disclosure.
Figure 7:
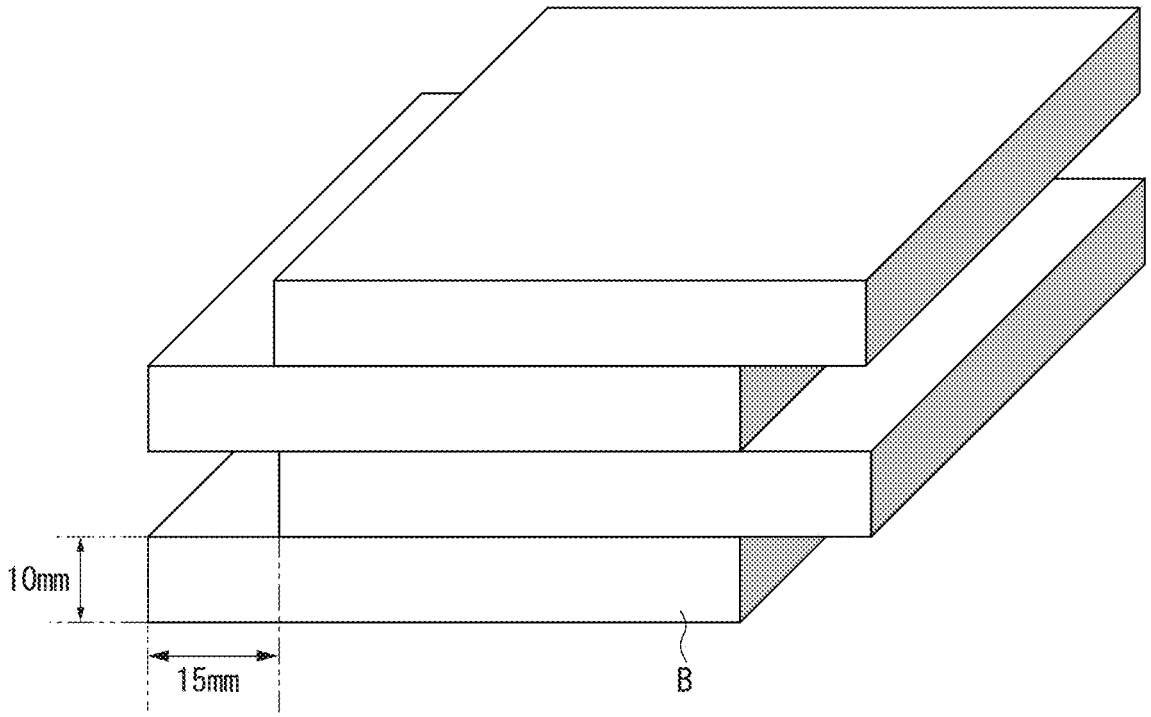
FIG. 7 is a view showing a still another example of a sheet bundle (a medium bundle) according to the embodiment of the present disclosure.

With reference to FIG. 5 to FIG. 7, a relationship between the thickness of the sheet bundle B and the easiness of taking out the sheet bundles B separately will be considered. In FIG. 5 to FIG. 7, the sheet bundle B is stacked on each of two shift positions P2. In FIG. 5, the thickness of the sheet bundle B is 1 mm and the distance between the end portions of the shift positions P2 (the shift distance) is 30 mm. If the shift distance is 30 mm as shown in FIG. 5, it is easy for more users to take out the sheet bundles B separately.

On the other hand, in FIG. 6, although the thickness of the sheet bundle B is 1 mm, the distance between the end portions of the shift positions P2 (the shift distance) is 15 mm shorter than that of the example shown in FIG. 5. If the shift distance is 15 mm as shown in FIG. 6, it is difficult for more users to take out the sheet bundles B separately.

In FIG. 7, compared with cases shown in FIG. 5 and FIG. 6, the thickness of the sheet bundle B is 10 mm thicker than 1 mm. In this case, even if the distance between the end portions of the shift positions P2 (the shift distance) is 15 mm, it is easy for more user to take out the sheet bundles B separately.

As described above, in a case where the thickness of the sheet bundle B is fixed, as the sheet distance increases, it is easier for the user to take out the sheet bundles B separately. In a case where the shift distance is fixed, as the thickness of the sheet bundle B increases, it is easier for the user to take out the sheet bundles B separately.

Based on the above described knowledge, the present embodiment improves a conventional configuration that the shift distance is fixed and the number of the candidates of the shift position is "2 (two)" only, and proposes an improved configuration that the shift distance is variable depending on the thickness of the sheet bundle B and the user can select the number of the candidates of the shift position P2 from "2 (two)", "3 (three)" and "4 (four)". In the other words, the present embodiment applies a configuration that as the thickness of the sheet bundle B increases, the number of the candidates of the shift position P2 increases. The thickness of the sheet bundle B is calculatable based on weight information of the sheet S (for example, a weight of the sheet S) and a number of the sheets S contained in the sheet bundle B.

Additionally, the present embodiment applies a configuration that as the number of the candidates of the shift position P2 increases, the shift distance decreases. For example, in the above A4-size sheet adaptable machine (the paper width of 210 mm and the discharge port width of 240 mm), when the number of the candidates of the shift position P is "2 (two)", the shift distance is set to 30 mm, when the number of the candidates of the shift position P is "3 (three)", the shift distance is set to 15 mm, and when the number of the candidates of the shift position P is "4 (four)", the shift distance is set to 10 mm.

Figure 8:
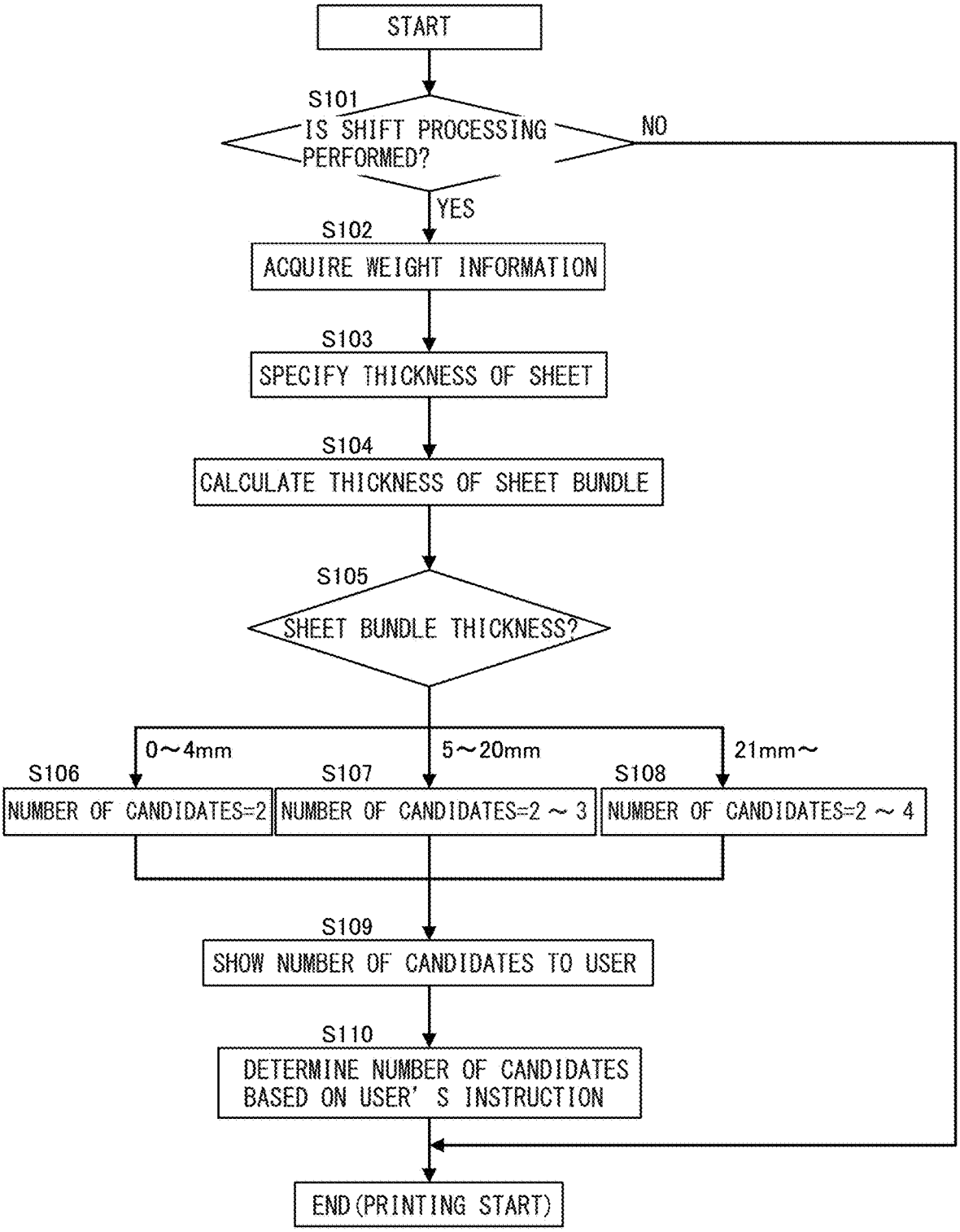
FIG. 8 is a flowchart showing a control for the shift position in the medium processing device according to the embodiment of the present disclosure.

Hereinafter, with reference to FIG. 8, a specific processing of the present embodiment will be described. FIG. 8 is a flowchart for control of the shift position P2 in the medium processing device 2. According to the processing flow, properties executable interactively when the user instructs the printing using the touch panel 50 or the external personal computer are set.

When the flow of FIG. 8 is started, the first control part 40 inquires of the user whether the shift processing (the sorting processing) for the sheet bundles B is performed or not, via the touch panel 50 or a monitor of the personal computer (step S101). The user instructs whether the shift processing is performed or not, using the touch panel 50 or the monitor of the personal computer.

When the user instructs that "the shift processing is not performed" (S101: NO), the first control part 40 finishes the processing flow and then starts the printing processing.

On the other hand, when the user instructs that "the shift processing is performed" (S101: YES), the first control part 40 acquires the weight information of the sheet S on which the image is formed (step S102). More practically, for example, based on the type (a plain paper, a cardboard, a bond paper, an envelope or the like) of the sheet S selected by the user, the weight information of the sheet S is acquired. A correlation of the type of the sheet S with the weight is preferably performed based on a correlation table previously stored in the storage part 42 (or the storage part 62).

Alternatively, a configuration that the user directly inputs or selects the weight of the sheet S using the touch panel 50 or the like is applicable.

When the weight information is acquired, the first control part 40 specifies a thickness of the sheet S (step S103). More practically, the first control part 40 refers to the table T shown in FIG. 9, and specifies the thickness of the sheet S based on the weight information (the weight of the sheet S) acquired in step S102, for example. The above table T is preferably stored in the storage part 42 or the storage part 62.

When the weight of the sheet S is specified, the first control part 40 calculates a thickness of the sheet bundle B (step S104). More practically, the thickness of the sheet bundle B is preferably calculated by multiplying the thickness of the sheet S, which is specified in step S103, by a number of the sheets S contained in the sheet bundle B, which is input by the user.

Next, the first control part 40 determines a number of the candidates of the shift position P2 where the shift part 26 of the medium processing device 2 can shift the sheet bundle B, based on the calculated thickness of the sheet bundle B (step S105 to step S108). More practically, for example, when the thickness of the sheet bundle B exceeds 0 mm and smaller than or equal to 4 mm, the first control part 40 determines that the number of the candidates of the shift position P2, which is selectable by the user, is "2 (two)" only (step S106), when the thickness of the sheet bundle B exceeds 4 mm and smaller than or equal to 20 mm, the first control part 40 determines that the number of the candidates of the shift position P2, which is selectable by the user, is "2 (two)" or "3 (three)" (step S107), and when the thickness of the sheet bundle B exceeds 20 mm, the first control part 40 determines that the number of the candidates of the shift position P2, which is selectable by the user, is "2 (two)", "3 (three)" or "4 (four)" (step S108). Additionally, the first control part 40 sets the shift distance to 30 mm when the number of the candidates of the shift position P2 is "2 (two)", to 15 mm when the number of the candidates of the shift position P2 is "3 (three)", and to 10 mm when the number of the candidates of the shift position P2 is "4 (four)". That is, the control is executed such that the number of the candidates of the shift position P2 increases as the thickness of the sheet bundle B increases, and the shift distance decreases as the number of the candidates of the shift position P2 increases.

When the number of the candidates of the shift position P2, which is selectable by the user, is determined, the first control part 40 shows the number of the candidates of the shift position P2 on the touch panel 50 or the monitor of the personal computer (step S109). The user instructs the number of the candidates of the shift position P2 so as to be applicable for the proceeding printing processing, to the first control part 40 by the touch panel 50 or the monitor of the personal computer. The first control part 40 determines the number of the candidates of the shift position P2 based on the instruction from the user (step S110).

When the number of the candidates of the shift position P2, selectable by the user, is single (for example, in a case of step S106), the number of the candidates is automatically selected, and the processing in step S109 and step S110 is skipped, preferably.

When the above flowchart is finished, the image forming apparatus 100 (the multifunctional peripheral 1 and the medium processing device 2) performs the printing processing and the post-processing based on the determined number of the candidates of the shift position P2.

In the above configuration, the first control part 40 of the multifunctional peripheral 1 executes the control flow shown in FIG. 8; it is clearly understood that the second control part 60 of the medium processing device 2 may execute the control flow shown in FIG. 8.

7. A Technical Effect of the Present Embodiment

In the above described embodiment, the medium processing device 2 includes the discharge roller 29, the discharge tray 31 and the shift part 26. The discharge roller 29 discharges the sheet S (the sheet-shaped medium) from the discharge position to the Y direction (a predetermined discharge direction) through the post-processing side sheet discharge port 23. On the discharge tray 31, the sheet S discharged by the discharge roller 29 through the post-processing side sheet discharge port 23 is stacked. The shift part 26 varies the relative position of the discharge position and the discharge tray 31 in the X direction (the shift direction) perpendicular to the Y direction to shift the shift position P2 where the sheet S is stacked on the discharge tray 31. The first control part 40 and/or the second control part 60 controls the shift part 26 so as to shift the shift position P2 for each sheet bundle B containing the plurality of sheets S. Then, the first control part 40 and/or the second control part 60 calculates the thickness of the sheet bundle B to be discharged, and makes it possible to select the number of the shift position P2 from the plurality of candidates when the calculated thickness exceeds the first threshold value (for example, 4 mm).

According to the above configuration, when the user easily takes out the sheet bundles B separately because the sheet bundle B has a thickness larger than the predetermined thickness, the number of the shift position P2 is selectable from the plurality of candidates. Additionally, according to the configuration, compared with a case where the number of the shift position P2 is selectable from the plurality of candidates regardless of the thickness of the sheet bundle B, it becomes possible to increase the number of candidates of the shift position P2 while keeping easiness of taking out the sheet bundles B separately.

Additionally, in the configuration of the present embodiment, it becomes possible to increase the number of candidates of the shift position P2 as the thickness of the sheet bundle B increases. According to the above configuration, it becomes possible to increase the number of candidates of the shift position P2 as the thickness of the sheet bundle B increases, that is, as the sheet bundles B are taken out separately more easily. Accordingly, a convenience performance for the user is more improved.

Additionally, in the configuration of the present embodiment, the shift distance between the end portions of the shift positions P2 decreases as the number of the candidates of the shift position P2 increases. According to the above configuration, because the shift distance decreases even if the number of the candidates of the shift position P2 increases, it becomes possible to increase the number of candidates of the shift position P2 without widening the width of the post-processing side sheet discharge port 23.

Additionally, in the configuration of the present embodiment, the number of the shift position P2 is selectable from the plurality of candidates including "2 (two)", "3 (three)" and "4 (four)" when the thickness of the sheet bundle B exceeds the second threshold value (for example, 20 mm), the number of the shift position P2 is selectable from the candidates including "2 (two)" and "3 (three)" when the thickness of the sheet bundle B is smaller than or equal to the second threshold value and exceeds the first threshold value (for example, 4 mm), the number of the shift position P2 is set to the candidate of "2 (two)" when the thickness of the sheet bundle B is smaller than or equal to the first threshold value. According to the above configuration, because the thickness of the sheet bundle B is classified into predetermined ranges and the number of the candidates of the shift position P2 is set for each range, the configuration of the present disclosure can be achieved by more simple way.

In the configuration (the a A4-size sheet adaptable machine) of which a width of the sheet S in the X direction is 210 mm and a width of the post-processing side sheet discharge port 23 in the X direction is 240 mm, by specifying the first threshold value and the second threshold value to the above values (4 mm and 20 mm, respectively), the above technical effect can be remarkably exhibited.

Additionally, according to the configuration of the present embodiment, in the medium processing device 2 including the processing tray 28 on which the sheet bundle B is temporarily placed before discharged to the discharge tray 31, the shift part 26 regulates the position of the shift bundle B on the processing tray 28 in the shift direction and shifts the placement position of the sheet bundle B on the processing tray 28 to shift the discharge position of the sheet bundle B in the post-processing side sheet discharge port 23. According to the above configuration, even if the discharge tray 31 is fixed (at least with respect to the shift direction), it becomes possible to vary the relative positional relationship between the discharge position and the discharge tray 31.

According to the configuration of the present embodiment, the image forming apparatus 100 can be provided, which includes the medium processing device 2 in which the number of the shift position P2 is selectable from the plurality of candidates.

8. Modified Examples

In the above embodiment of the present disclosure, the image forming apparatus 100 includes the multifunctional peripheral 1 and the medium processing device 2 which exist separately and are connected to each other. However, the image forming apparatus 100 is configured to be a single device having the both performance of the above multifunctional peripheral 1 and the above medium processing device 2. In this case, it is clearly understood that the image forming apparatus 100 may be regarded as the medium processing device.

In the above embodiment of the present disclosure, the shift part 26 of the medium processing device 2 shifts the discharge position of the sheet S with respect to the discharge tray 31. However, a configuration that the shift part 26 shifts the position of the discharge tray 31 with respect to the discharge position of the sheet S (that is, the discharge tray 31 is movable and the shift part 26 shifts the discharge tray 31) may be applied. That is, the shift part 26 may have any configuration that the relative position of the discharge position of the sheet S and the discharge tray 31 is shifted in the shift direction.

In the above embodiment of the present disclosure, a case where the configuration of the present disclosure is applied to the printer 1 is described. On the other hand, in other embodiments, the configuration of the disclosure may be applied to another image forming apparatus, such as a copying machine, a facsimile or a printer, except for the multifunctional peripheral 1.

While the above description of the embodiments of the present disclosure describes above preferable embodiment in the image forming apparatus according to the present disclosure and various technically preferable configurations have been illustrated, a technical range of the invention is not to be restricted by the embodiment unless there is the description limited to the present disclosure. That is, the components in the embodiment of the invention may be suitably replaced with other components, or variously combined with the other known components. The claims are not restricted by the description of the embodiment of the invention as mentioned above.

The invention claimed is:

1. A medium processing device comprising:

a discharge member configured to discharge a sheet-shaped medium from a discharge position in a predetermined discharge direction;

a discharge tray on which the medium discharged by the discharge member is stacked;

a shift part configured to vary a relative position of the discharge position and the discharge tray in a shift direction perpendicular to the discharge direction to shift a shift position where the medium is stacked on the discharge tray; and a control part configured to control the shift part so as to shift the shift position for each medium bundle containing a plurality of the mediums, wherein the control part calculates a thickness of the medium bundle, and when the calculated thickness exceeds a first threshold value, the control part makes it possible to select a number of the shift position from a plurality of candidates.

2. The medium processing device according to claim 1, wherein the control part allows a number of the candidates of the shift position to increase as the thickness of the medium bundle increases.

3. The medium processing device according to claim 2, wherein the control part allows a shift distance between end portions of the shift positions in the shift direction to decrease as the number of the candidates of the shift position increases.

4. The medium processing device according to claim 1, wherein the control part allows a shift distance between end portions of the shift positions in the shift direction to decrease as the thickness of the medium bundle increases.

5. The medium processing device according to claim 1, wherein when the thickness of the medium bundle exceeds a second threshold value larger than the first threshold value, the control part makes it possible to select the number of the candidates of the shift position from 2 (two), 3 (three) or 4 (four), when the thickness of the medium bundle is smaller than or equal to the second threshold value and exceeds the first threshold value, the control part makes it possible to select the number of the candidates from 2 (two) or 3 (three), and when the thickness of the medium bundle is smaller than or equal to the first threshold value, the control part sets the number of the candidates to 2 (two).

6. The medium processing device according to claim 1, wherein the shift part shifts the discharge position with respect to the discharge tray in the shift direction to shift the shift position.

7. The medium processing device according to claim 1, further comprising a processing tray on which the medium bundle is temporarily placed before the medium bundle is discharged on the discharge tray, wherein the shift part regulates a position of the medium bundle in the shift direction on the processing tray and shifts a placement position of the medium bundle on the processing tray to shift the discharge position.

8. The medium processing device according to claim 1, wherein the control part specifies a thickness of the medium from a weight of the medium and calculates the thickness of the medium bundle based on the specified thickness and a number of the sheets contained in the medium bundle.

9. An image forming apparatus comprising the medium processing device according to claim 1.

* * * * *